US005921755A

United States Patent [19]

Eldridge

[11] Patent Number: 5,921,755

[45] Date of Patent: Jul. 13, 1999

[54] DRY VACUUM PUMP

[75] Inventor: John W. Eldridge, Merrimack, N.H.

[73] Assignee: Dry Vacuum Technologies, Inc., Merrimack, N.H.

[21] Appl. No.: 08/845,192

[22] Filed: Apr. 21, 1997

[51] Int. Cl.[6] ..... F04B 3/00; F04B 7/04

[52] U.S. Cl. ..... 417/255; 417/570; 417/501; 92/155; 92/216; 92/220; 92/169.1

[58] Field of Search ..... 417/255, 521, 417/570, 493, 501; 92/155, 216, 220, 169.1

[56] References Cited

U.S. PATENT DOCUMENTS

| | | | |
|---|---|---|---|
| 2,258,426 | 10/1941 | Smith | 417/570 |
| 2,478,294 | 8/1949 | Madsen | 92/220 |
| 2,751,146 | 6/1956 | Moseley | 417/255 |
| 2,817,562 | 12/1957 | Fleming et al. | 92/155 |
| 3,338,509 | 8/1967 | McAninch | 417/255 |

*Primary Examiner*—Charles G. Freay

*Attorney, Agent, or Firm*—Sughrue, Mion, Zinn, Macpeak & Seas, PLLC

[57] ABSTRACT

A vacuum pump is provided with at least one cylinder having a cylinder liner and a piston mounted for reciprocating movement within the cylinder liner. The piston is connected to a crankshaft for reciprocating the piston and the piston is provided with a piston head having a flat face and an upper end thereof. A valve plate having a flat surface facing the flat surface of the piston head is biased into engagement with the end of the cylinder liner whereby upward movement of the piston the flat face of the piston head makes full contact with the flat face of the valve plate to move the valve plate away from the cylinder liner. The piston is provided with two annular lip seals having an L-shaped configuration disposed in opposite directions at opposite ends of the piston in engagement with the cylinder liner.

8 Claims, 3 Drawing Sheets

DRY VACUUM PUMP

BACKGROUND OF THE INVENTION

The present invention is directed to a dry (oil free) piston type vacuum pump and more specifically to a vacuum pump having two piston and cylinder assemblies operatively connected to a common drive shaft with each piston having a pair of gapless full contact lip seals engaging the cylinder and an outlet valve plate which covers the entire piston diameter and which makes full face contact with the piston to minimize dead volume between the piston and the valve plate.

At present, pre-pumping to a rough vacuum is usually carried out by an oil-seal rotary pump which is both lubricated and sealed with hydrocarbon or fluorocarbon oil. Some of the oil molecules are degraded and fragmented into smaller molecules during the operation of the rotary pump and the small hydrocarbon and fluorocarbon molecules exhibit a high vapor pressure relative to that of the oil before the latter was used in the pump. It is difficult to prevent the small molecules from passing back from the pump and entering the vacuum vessel where they contaminate all the surfaces of the vessel and the contents by coating them within an adherent oily film. Such a film is completely unacceptable in many high technology areas. Further problems are associated with the maintenance of the correct oil level and the disposal of used oil. Such maintenance is time consuming and costly.

In order to provide an oil free pump an attempt was made to utilize split polytetrafluoroethylene (PTFE) sealing rings backed by split, spring-steel bands or other expansion means. However, it was impossible to achieve a high vacuum with such pumps due to the inevitable leakage due to the split. In order to overcome this problem, a clearance seal was developed wherein a sleeve of low friction material was disposed on the cylindrical surface of a piston head such that over the temperature range encountered during normal operation of the pump, a mean gap was sustained about the sleeve between the sleeve and the cylinder, which gap is of a maximum size at which leakage of gas past the sleeve is at a level acceptable for a vacuum to be sustained by the pump. Such a clearance type seal is disclosed in the U.S. Pat. No. 4,790,726 to Balkau et al.

Another problem encountered with vacuum pumps resided in the fact that at extremely low pressures the pressure of the gas compressed by the cylinder might be insufficient to open the exhaust valve at the top of the cylinder. Accordingly, valves were designed to open upon contact with the piston at the top dead center position of the piston to facilitate the exhausting of the compressed gas. Such a valve is disclosed in the U.S. Pat. No. 4,790,726 to Balkau et al. as well as the U.S. Pat. No. 4,854,825 to Bez et al. both of these patents disclose a portion of a valve member protruding into the cylinder for contact by the piston to open the valve. However, a considerable volume of dead space still remained between the piston and the cylinder head causing the ultimate pressure to remain high.

SUMMARY OF THE INVENTION

The present invention is directed to a new and improved dry vacuum pump having fewer parts, a compact size, good vacuum performance, 10,000 hours MTBF and a low production cost.

The present invention is directed to a new and improved dry vacuum pump comprised of two piston and cylinder assemblies disposed at an angle to each other and using only two valves, one in each cylinder for the exhaust gases from each cylinder. Inlet valving is provided by each piston as it reaches bottom dead center at which point it is below the inlet porting in the cylinder wall. The piston on the upstroke first passes and closes off the inlet porting then travels to the top of the cylinder thereby compressing the gas. When the piston approaches the top of the cylinder it makes full flat face contact with the valve plate at the valve's closed plane and carries the valve plate to a point above, which is the piston top dead center, thereby allowing any compressed gas to escape around the valve plate. Such an arrangement of the valve plate and the piston substantially eliminates all dead volume between the piston and the valve plate. The gas from the first cylinder is carried after exhaust from the valve associated therewith to the inlet of the second cylinder via internal passages. The same operating cycle occurs in the second cylinder and the gas is exhausted to atmosphere through the valve at the top of the second cylinder. The crankcase of the pump is evacuated through a passage connecting the crankcase to the passage between the cylinders of the pump. Each piston is provided with two annular lip seals adjacent the top and bottom of the piston respectively.

The above and other objects, features and advantages of the present invention will be more apparent and more readily appreciated from the following detailed description of a preferred exemplary embodiment of the present invention taken in connection with the accompanying drawings.

DETAILED DESCRIPTION OF THE INVENTION

Figure 1:
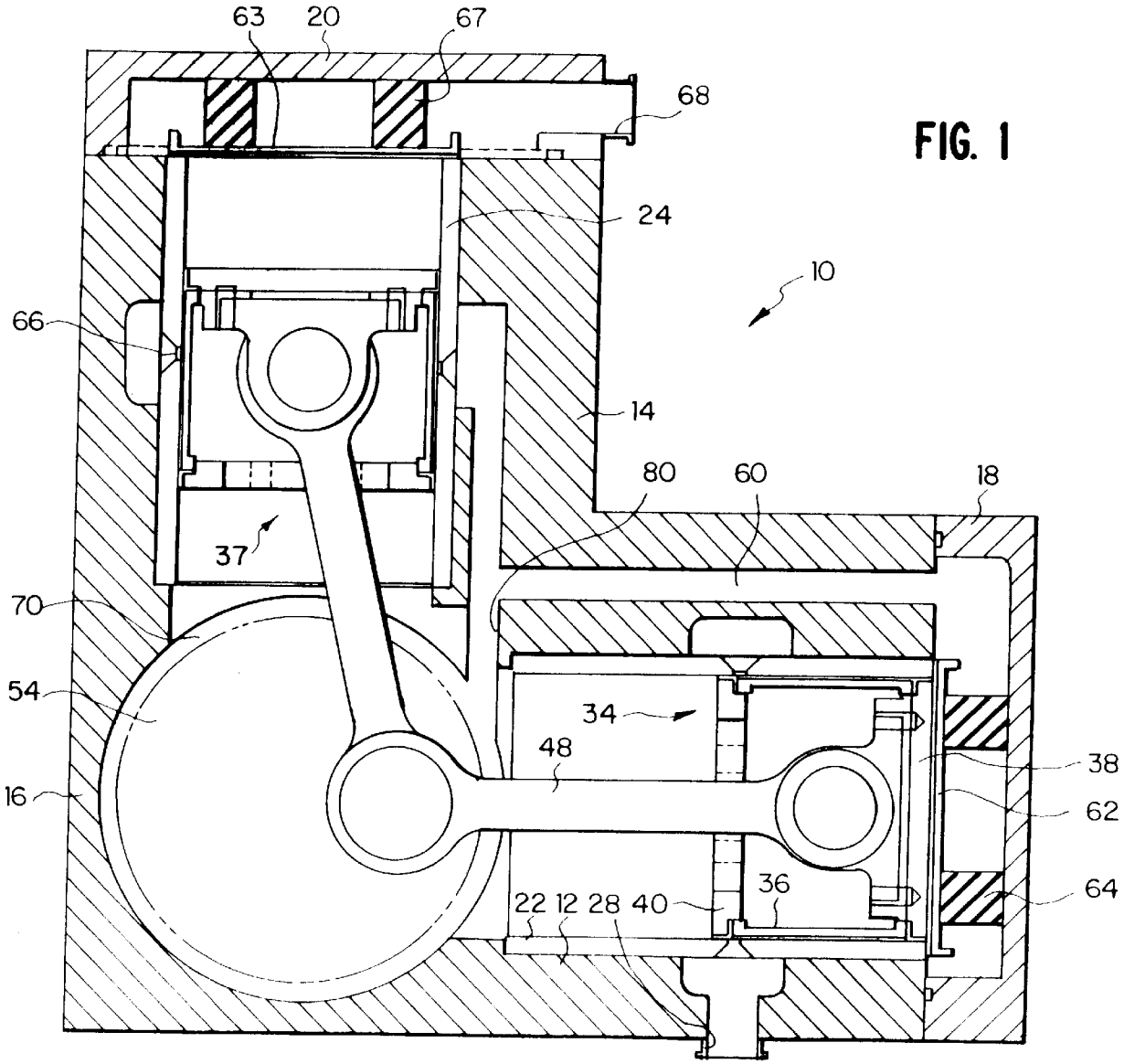
FIG. 1 is a cross sectional view of the vacuum pump according to the present invention with one of the piston assemblies removed from the associated cylinder.
Figure 2:
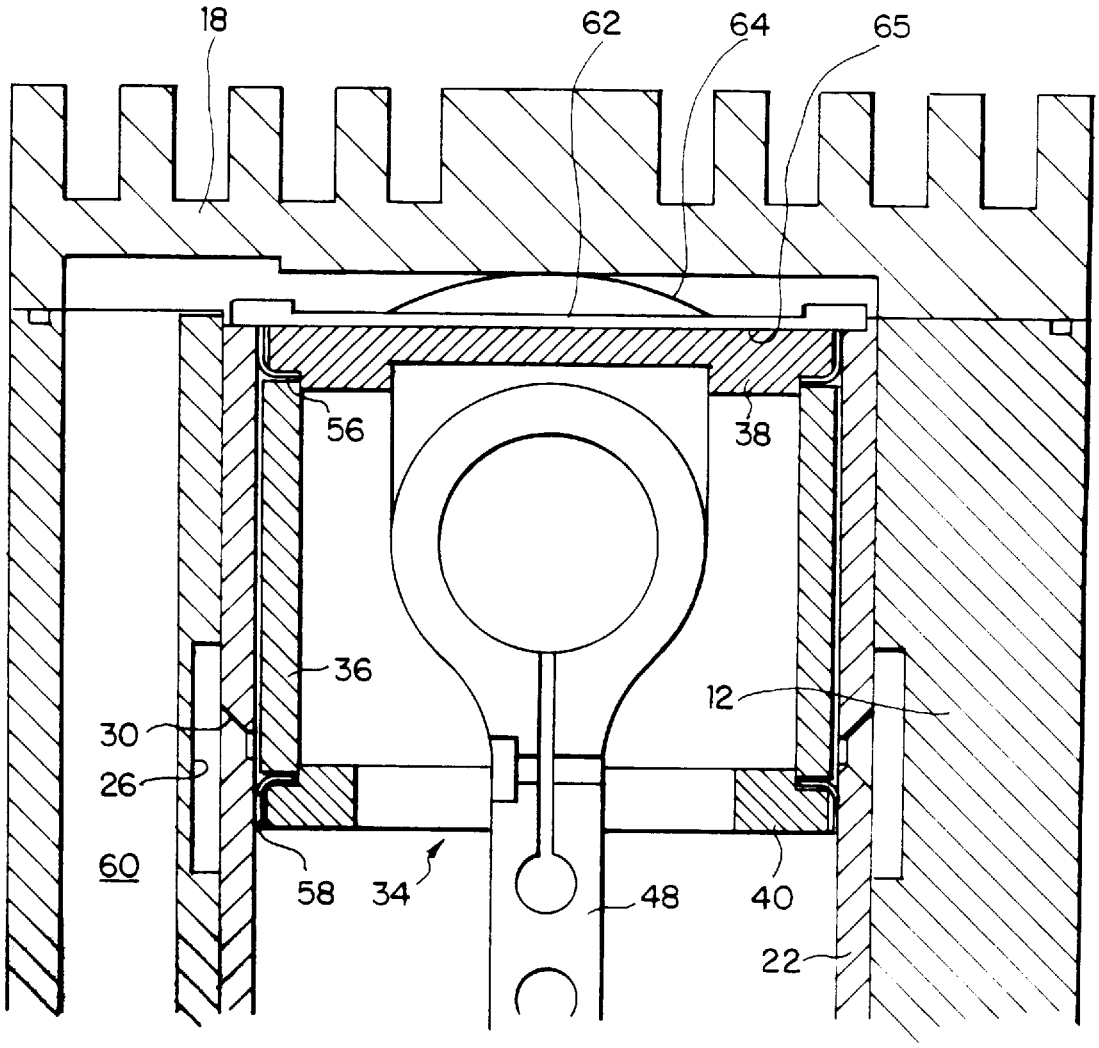
FIG. 2 is a an enlarged cross sectional view of a single piston and cylinder assembly.
Figure 3:
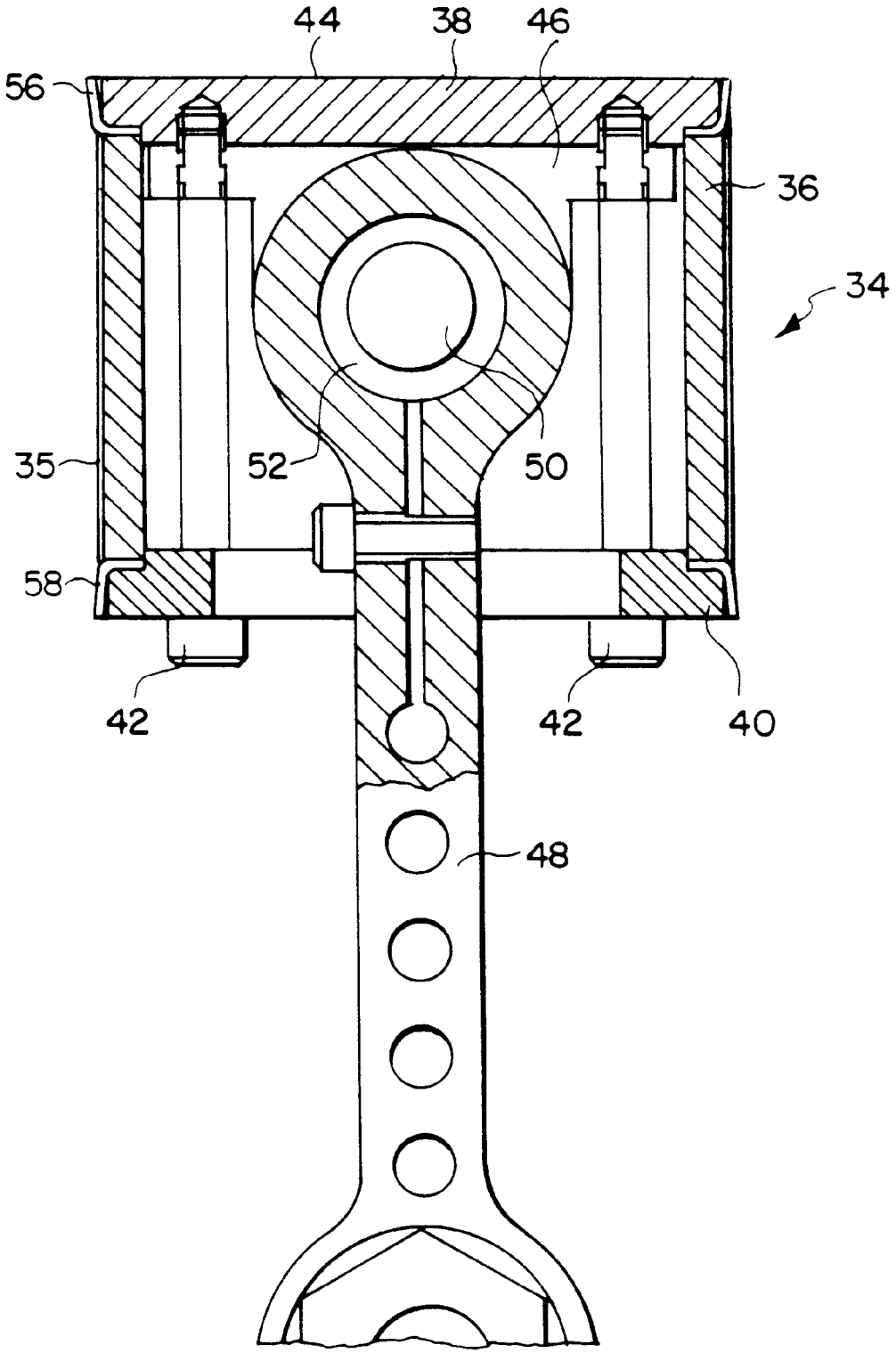
FIG. 3 is a an enlarged detail view of a single piston assembly per se.

The vacuum pump 10 as shown in FIG. 1, is comprised of a first cylinder 12 and a second cylinder 14 connected to a crankcase 16 at right angles to each other. A cylinder head 18 is secured to the first cylinder 12 and a second cylinder head 20 is connected to the second cylinder 14 by conventional means. The first cylinder 12 is provided with a cylinder liner sleeve 22 and the second cylinder 14 is provided with a second cylinder liner sleeve 24 having high wear resistance characteristics. As shown in FIG. 2, the first cylinder is provided with an annular internal groove 26 which is adapted to be connected by means of a radially extending inlet passage 28 to the vessel to be evacuated. The liner sleeve 22 is provided with a plurality of radially extending through openings 30 disposed about the circumference of the sleeve in spaced apart relation for communicating the groove 26 with the interior of the liner sleeve 22. A piston 34 is mounted for reciprocation within the liner 22 and is comprised of a hollow cylindrical body 36 which is clamped between the piston head 38 and a bottom clamping ring 40 by means of bolts 42 as best seen in FIG. 3. The piston head 38 is provided with a smooth, flat upper surface 44 and an inwardly extending projection 46 to which the piston rod 48 is rotatably mounted by means of a stub shaft 50 and bearing ring 52 (FIG. 3). The piston rod 48 is connected to a crank member 54 which is mounted on a drive shaft extending through the crankcase 16 in a conventional manner.

The piston 34 is provided with a pair of full contact lip seals 56 and 58 at the top and bottom of the piston, respectively. The lip seals may be constructed of PTFE or similar materials as well as metal and are clamped between the piston head 38 and the piston body 36 and the bottom clamping ring 40 and the piston body 36, respectively, to provide a sealed engagement between the lip seals and the piston. Each lip seal in the relaxed condition, as shown in FIG. 3, has a substantially L-shaped cross sectional configuration with a radial gap between each lip seal and the piston head and bottom clamping ring, respectively. Thus when the piston is introduced into the close confines of the cylinder liner, the lip seals will be in full contact with the liner at all times while still providing a radial gap between the piston and each lip seal.

With respect to the function of any sealing ring in a vacuum pump, it is necessary to consider that the ring must be capable of sealing against the piston and at the same time making a seal against the cylinder wall. On the present pump the seals against the cylinder walls are "dynamic" or "flexible" to allow for mechanical inaccuracies, temperature variations and automatic adjustment to allow for wear. The seals are positively sealed to the piston body by the clamping arrangement. The sealing force which is applied to produce a seal against the piston is applied in the axial direction of the piston (in the direction of piston travel) while the force applied to the cylinder is applied at right angles (in a radial direction). In other words, the two forces which are needed have been separated and can be adjusted independently to meet the particular needs of the seal. The radial force against the cylinder, will follow the pressure variations produced by the cylinder when compressing gas and the magnitude of the force can be conveniently adjusted by varying the axial length of the seal. The minimum force which must always be present to keep the seal in contact with the cylinder is a function of the material and its thickness. The "L-shape" has a further advantage in that it produces different forces against the cylinder depending on the direction of travel. In the travel direction toward the open end of the seal, the force against the cylinder wall is higher due to the frictional reaction than it is in the reverse direction. The wear on the seals is a function of the velocity of travel, the temperature and the force applied to it. By reducing the force, (during 50% of the time) the wear is decreased.

Considering a conventional piston ring, generally of rectangular cross section, such as is used in some vacuum pumps, it is easy to see that it is very difficult to maintain a positive seal against the piston while at the same time allowing the piston ring to "float" in a radial direction and react to the small pressure being developed by the piston.

The very much smaller cross section of the "L" ring allows better heat transfer to the cylinder and the piston than the conventional piston ring which has a much larger cross section.

The seals 56 and 58 provide good contact and the sealing force is proportional to pressure of gasses upon compression exerting the force on the seal via the radial clearance. This allows complete isolation of gasses between the inlet, the crankcase, the transfer passage and the cylinder components of the pump. The piston cylinder body 34 may be covered with a wear resistant material 35 (FIG. 3), but unlike previous designs, this surface is not a close clearance seal but is strictly a contact wear surface if needed. This allows less restrictive tolerances in machining and alignment of the cylinder components. The most important aspect of the gapless full contact lip seals is that the short contact seal, which is 5 mm long, has shown to be over 200 times more effective than a 50 mm length conventional close clearance seal. The increase in compression ratio with the use of a gapless full contact lip seal enables the pump, in a series configuration, to produce similar vacua using two stages of compression as was commonly done with three or more stages in series in earlier designs. It is possible to obtain compression ratios in excess of 100,000 for the present two stage series design versus three or more compression stages in series to obtain similar compression in earlier designs.

A transfer passage 60 is formed in the cylinder and crankcase walls and is disposed in communication with the end of the first cylinder between the first cylinder and the cylinder head 18. A valve plate 62 having a diameter larger than the outside diameter of the cylinder liner 22 is covered with a flat coating or layer of resilient material 65 on a flat bottom surface as best seen in FIG. 2, which seals the valve relative to the end of the cylinder liner 22. A spring 64 comprised of an annular ring of elastomeric material is disposed between the valve plate 62 and the cylinder head 18 for normally biasing the valve plate into engagement with the cylinder liner 22.

A piston 37 and valve plate 63 are provided for the second cylinder, along with an elastomeric spring member 67. The transfer passage 60 will transfer the compressed gasses from the first cylinder 12 via the crankcase to the inlet ports 66 in the cylinder liner 24 of the second cylinder 14. An outlet passage 68 extends through the cylinder head 20 for the exhaust of gasses from the second cylinder to the atmosphere. The seals and wear resistant covering for the piston 35 are identical to those shown for piston 34.

With the pump arranged in a series operation configuration as shown in FIG. 1, the piston 34 on its upstroke, travels to the closed plane of the valve plate and makes full surface contact with the valve plate 62 and remains in contact with the valve plate as they ascend to the piston top dead center. As the piston and valve ascend, a radial gap is opened and the compressed gas can enter the transfer passage 60 to the next stage of the pump. After reaching top dead center, the valve plate remains in full contact with the piston during descent until the valve plate makes contact with and seals on the top of the cylinder liner. The dead volume at the top of the cylinder associated with the valves of earlier designs is substantially eliminated and this increases the efficiency of the cylinder operation to produce much lower pressure. In the second cylinder of the series pump, as shown in FIG. 1, the piston 37 compresses the gas and opens the valve plate associated therewith in the same manner as the first piston and cylinder arrangement. The resilient surface on the valve plate conforms to the piston top surface assisting in the elimination of any dead gas volume. This valve design is compliant in two respects. First, because it allows less restrictive manufacturing tolerances yet allows for the elimination of all possible dead volume between the piston and valve plate for obtaining maximum gas compression. Secondly, with this design, the ingestion of foreign material may degrade vacuum performance but without subsequent mechanical damage to the piston or valve that occurs when a solid cylinder head and a separate fixed valve plate are used and in close tolerance piston/valve interfaces as was the case in earlier designs.

In order to evacuate the crankcase chamber 70 and eliminate any valving, a connection or passage 80 is provided between the crankcase and the transfer passage 60. The crankcase pressure reaches equilibrium with the cylinder. This allows the motor power requirements to be reduced and improves cylinder operating efficiency. This also offers an additional advantage in that the connection allows balancing of the forces on the pistons by the exchange of pressure between the cylinders and the crankcase as the pump is vented to high pressure.

While the invention has been illustrated and described with the piston and cylinder assemblies disposed with the axis of the assemblies at 90° relative to each other, the vacuum pump works equally as well with the assemblies disposed appropriate to each other at 180° or at any intermediate angle.

While the invention has been particularly shown and described with reference to preferred embodiments thereof, it will be understood by those in the art that the foregoing and other changes in form and details may be made therein without departing from the spirit and scope of the invention.

What is claimed is:

1. A vacuum pump comprising at least one cylinder having one end secured to a cylinder head and an opposite end secured to and in communication with a crankcase having a crankshaft rotatably mounted therein, a cylinder liner secured in said cylinder in spaced relation to said cylinder head, a piston mounted for reciprocating movement in said cylinder liner and connected to said crankshaft, said piston having a piston head with a flat surface on an upper end thereof, a valve plate having a flat surface with a diameter greater than an internal diameter of said cylinder liner disposed in a chamber between said cylinder head and said cylinder liner, resilient means for normally biasing said flat surface of said valve plate into engagement with an end of said cylinder liner, an inlet port disposed in said cylinder in communication with an interior of said cylinder liner through a plurality of circumferentially spaced openings in said cylinder liner and an outlet port located in said cylinder head in communication with said chamber, wherein upon upward movement of said piston said flat face of said piston head makes full face contact with said valve plate and moves said valve plate to a point above said cylinder liner which coincides with a top dead center position of a piston stroke to exhaust compressed gasses from said cylinder to said outlet port.

2. A vacuum pump as set forth in claim 1 wherein said flat face of said valve plate is provided with a flat layer of elastomeric material.

3. A vacuum pump as set forth in claim 1 wherein said piston is comprised of a hollow cylindrical body with said piston head secured to one end thereof and a ring secured to an opposite end thereof with a pair of annular oppositely extending L-shaped lip seals clamped between said cylindrical body and said piston head and said ring respectively wherein said lip seals are formed from a material which inherently biases said lip seals into engagement with said cylinder liner.

4. A vacuum pump as set forth in claim 3 wherein said hollow cylindrical body has a layer of low friction material on an outer surface thereof.

5. A vacuum pump as set forth in claim 1 wherein said resilient means is comprised of an annular ring of elastomeric material disposed between said cylinder head and said valve plate.

6. A vacuum pump as set forth in claim 1 further comprising a second cylinder having one end secured to a second cylinder head and having an opposite end secured to and in communication with said crankcase, a second cylinder liner disposed in said second cylinder in spaced relations to said cylinder head, a second piston identical to said first mentioned piston mounted for reciprocating movement within said second cylinder liner and connected to said crankshaft, a second valve plate substantially identical to said first mentioned valve plate and second resilient means for biasing said second valve plate into engagement with said second cylinder liner, passage means in said at least one cylinder and said second cylinder for communicating said outlet port with a second inlet port in communication with said interior of said second cylinder liner through a plurality of circumferentially spaced openings in said second cylinder liner and an outlet port for exhausting gasses from said second cylinder.

7. A vacuum pump as set forth in claim 6 wherein said passage means are disposed in communication with an interior of said crankcase.

8. A vacuum pump as set forth in claim 6 wherein said at least one cylinder and said second cylinder are disposed at 90° with respect to each other.

* * * * *